US011976452B2

(12) United States Patent
Hertrampf

(10) Patent No.: US 11,976,452 B2
(45) Date of Patent: May 7, 2024

(54) APPARATUS FOR DISCHARGING A LIQUID CONTAINING AT LEAST ONE ACTIVE SUBSTANCE INTO A TOILET BOWL COVERABLE BY A LID

(71) Applicant: Michael Hertrampf, Hamburg (DE)

(72) Inventor: Michael Hertrampf, Hamburg (DE)

(73) Assignee: Michael Hertrampf, Hamburg (DE)

( * ) Notice: Subject to any disclaimer, the term of this patent is extended or adjusted under 35 U.S.C. 154(b) by 22 days.

(21) Appl. No.: 17/622,359

(22) PCT Filed: Jun. 23, 2020

(86) PCT No.: PCT/DE2020/100534
§ 371 (c)(1),
(2) Date: Apr. 25, 2022

(87) PCT Pub. No.: WO2020/259757
PCT Pub. Date: Dec. 30, 2020

(65) Prior Publication Data

US 2023/0175243 A1 Jun. 8, 2023

(30) Foreign Application Priority Data

Jun. 26, 2019 (DE) ..... 102019117203.9

(51) Int. Cl.
*E03D 9/00* (2006.01)

(52) U.S. Cl.
CPC ..... *E03D 9/005* (2013.01)

(58) Field of Classification Search
CPC ..... E03D 9/005; A47K 13/302
See application file for complete search history.

(56) References Cited

U.S. PATENT DOCUMENTS 713,977 A * 11/1902 Gallagher ..... A47K 13/302 4/236
2,104,947 A * 1/1938 Joosten ..... A47K 13/302 4/234
2014/0096314 A1 4/2014 Ferro

FOREIGN PATENT DOCUMENTS

CN 101933781 A 1/2011
KR 200438841 3/2008
(Continued)

OTHER PUBLICATIONS

International Search Report and Written Opinion for PCT/DE2020/100534 dated Oct. 2, 2020.
German Search Report for German Application No. 102019117203.9.

*Primary Examiner* — Erin Deery
(74) *Attorney, Agent, or Firm* — Barnes & Thornburg LLP

(57) ABSTRACT

The invention relates to an apparatus for discharging a liquid containing at least one active substance into a toilet bowl coverable by a lid, the apparatus having a container receiving the liquid, which container is fixed in the toilet lid and is operatively connected to a discharging apparatus pointing into the toilet bowl such that the liquid is discharged into the toilet bowl via the discharging apparatus by pressure in the container. The object of the invention is to spray the liquid containing at least one active substance into a closed chamber in order to deploy an optimal operating force by means of a temporally dense sequence between application of the liquid and use of the toilet. This task is solved in that the toilet lid (7) has a passage opening (8) in which the container (9) is fixed such that, in relation to the installation position thereof, the top side (10, 24) thereof is accessible from the outside for manually exerting pressure, thus triggering a
(Continued)

Figure 1:
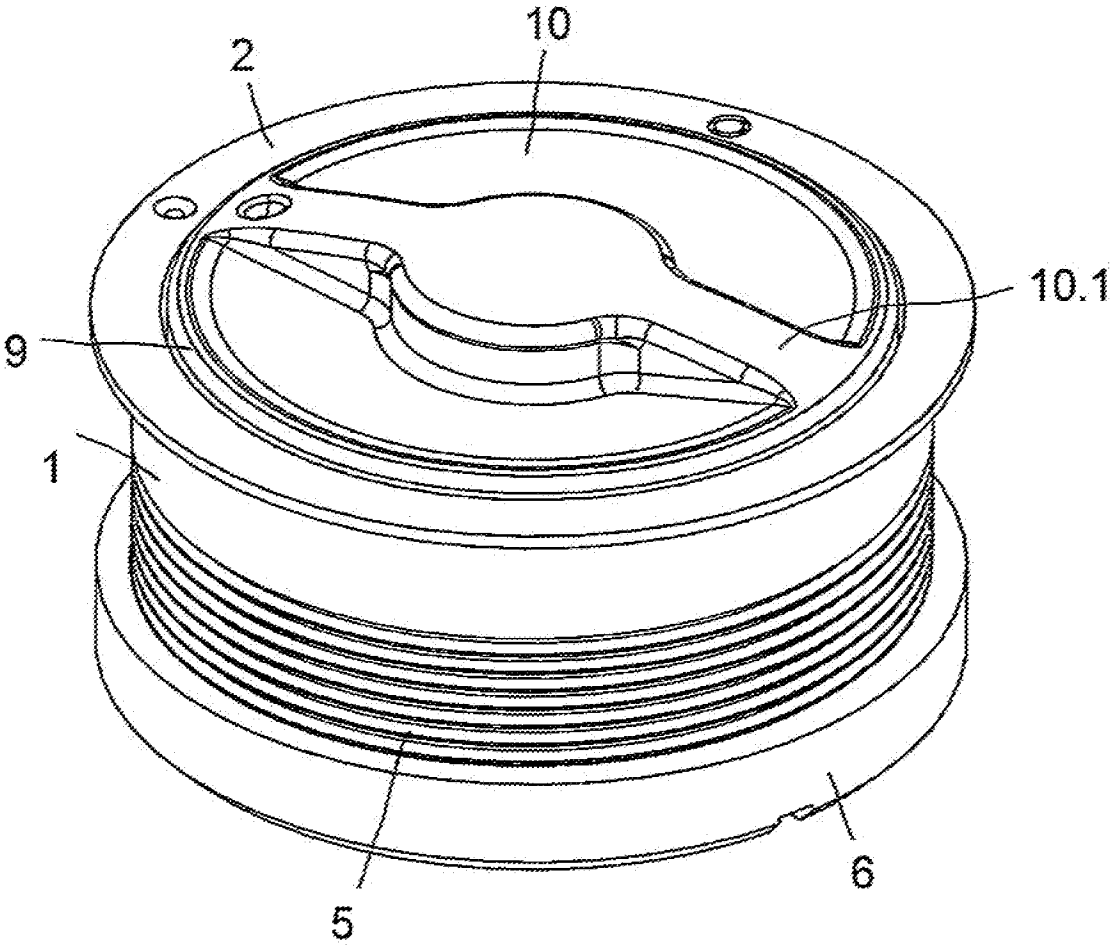

liquid discharge. Alternatively, the container (9) can also be an integral component of the toilet lid (7).

9 Claims, 20 Drawing Sheets

(56) References Cited

FOREIGN PATENT DOCUMENTS

| | | | |
|---|---|---|---|
| KR | 200438841 | Y1 * | 3/2008 |
| WO | 2019028520 | | 2/2019 |
| WO | 2020022954 | | 1/2020 |

* cited by examiner

APPARATUS FOR DISCHARGING A LIQUID CONTAINING AT LEAST ONE ACTIVE SUBSTANCE INTO A TOILET BOWL COVERABLE BY A LID

CROSS REFERENCE TO RELATED APPLICATIONS

This application is a U.S. national stage application under 35 U.S.C. § 371(b) of International Application No. PCT/DE2020/100534, filed Jun. 23, 2020, which claims priority to the German Patent Application No. 102019117203.9, filed on Jun. 26, 2019, the disclosures of both of which are hereby expressly incorporated by reference in their entirety.

The present invention relates to an apparatus for discharging a liquid containing at least one active substance into a toilet bowl coverable by a lid according to the preamble of claim 1.

For many people the generation of odour during toileting it is more than an inconvenience. Consequently, there is no lack of proposals or products aiming at solving this problem.

Oftentimes, these are systems suctioning off the unpleasant odours at the site of creation. Thus, the document DE 20 2010 012 612 U1 describes a direct air suction system via holes in the wall of a toilet bowl. In the citation DE 20 2010 015 219 U1. The odour suctioning happens directly at the toilet seat.

More advantageous than the technically complex air suctioning would be to absorb the unpleasant odour molecules, which can only occur as gas in the air, directly at the site of creation using a sprayed-in liquid containing suitable active substances which will catch the odour molecules like a web, the neutralising liquid certainly being most efficient when the liquid is discharged into an almost enclosed space. However, this can be achieved in an optimum manner only when the liquid is not discharged into the toilet bowl until shortly prior to the use of the toilet, i.e. at best when the user is already sitting on the toilet seat, thereby markedly reducing interim leakage of the sprayed-in liquid with its odour neutralising effect into the surrounding air.

A neutralising space of such nature is realised by means of a dosing device disclosed in the citation EP 596 952 A1. This device comprises a liquid container suspended on the outside of the rim of a toilet bowl from which a fluid pipe placed on top of the bowl rim runs into the toilet bowl, where a spray nozzle is arranged at the outlet of the fluid pipe. The region of the fluid pipe lying on top of the bowl rim acts as a peristaltic pump delivering via the nozzle structure a defined spray shot into the toilet bowl interior by placing a load on the toilet seat.

In the documents DE 1 609 234 PS and U.S. Pat. No. 2,760,209 devices are described which also exhibit these advantages. The container receiving the liquid containing at least one active substance is made from an elastic material and bent in a U shape. Its middle section rests on the bowl rim. Emanating from this middle section legs protrude downwards on both sides fixing the container on the bowl rim on the inside and outside. A nozzle is arranged at the end of the leg projecting into the toilet bowl. Placing a load onto the top of the toilet seat compresses the container causing a certain amount of liquid to be discharged via the nozzles.

The devices described above are relatively complex. The use of spray cans would be less complex. However, in this solution, the desired nearly enclosed neutralising space will always be reached only after a significant temporal delay because, in the sequence of events, it is necessary to first remove the cap from the spray can, then to spray the spray into the toilet bowl which is open at the top, then to put the cap back onto the spray can and set it aside, then to partly remove clothing and only then more or less closing the top of the toilet bowl by sitting thereon.

The disadvantages are overcome by a WC air purifier as described in the document DE 28 51 139 A1. This comprises a mounting intended to receive a spray can. The mounting is glued onto the underside of the toilet lid. It houses an axially guided plunger one end of which is in operative connection with the valve of the spray can while its other end facing the toilet seat terminates in a conical head. When the toilet lid is closed the conical surface of the head is in contact with the rim of the toilet seat an. Upon opening and closing the lid the plunger, owing to the conical shape of the head, is pressed against the valve of the spray can so that this opens and discharges a spray shot into the toilet bowl.

In this device according to the preamble the liquid containing at least one active substance is sprayed into an enclosed space in order to create optimum efficiency by providing a short-time succession of application of the liquid and use of the toilet. At the same time, the device is designed to be simple.

The citation WO 2019/028 520 A1 discloses a toilet seat cleaning device. In one embodiment example according to the FIGS. 1 and 2 this device comprises a docking device arranged on the outside of the toilet lid into which a replaceable container can be inserted which is filled with a cleaning liquid. Emanating from the docking device several conduits disposed inside the toilet lid lead radially outwards and terminate in spray nozzles pointing towards the toilet seat.

Inserting the container into the docking device creates a liquid connection of the container with the conduits.

The docking device includes a push knob which, when actuated, causes the liquid to be pressed from the container into the conduits by an increase of pressure or release of pressure respectively and finally to be sprayed by the spray nozzles onto the toilet seat. Then, the toilet seat can be cleaned, with the toilet lid being raised, e.g. using toilet paper.

Figure 3:
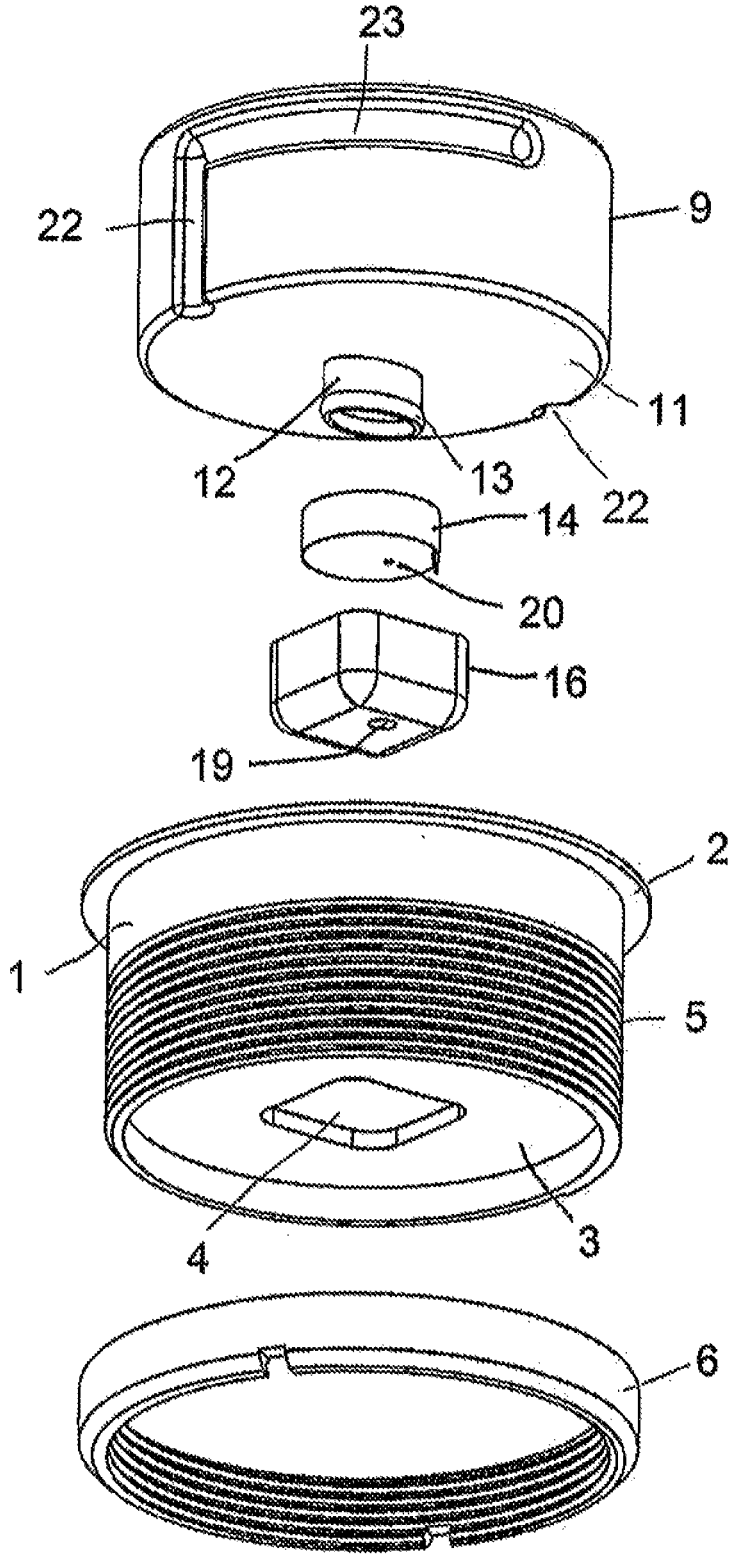
Figure 4:
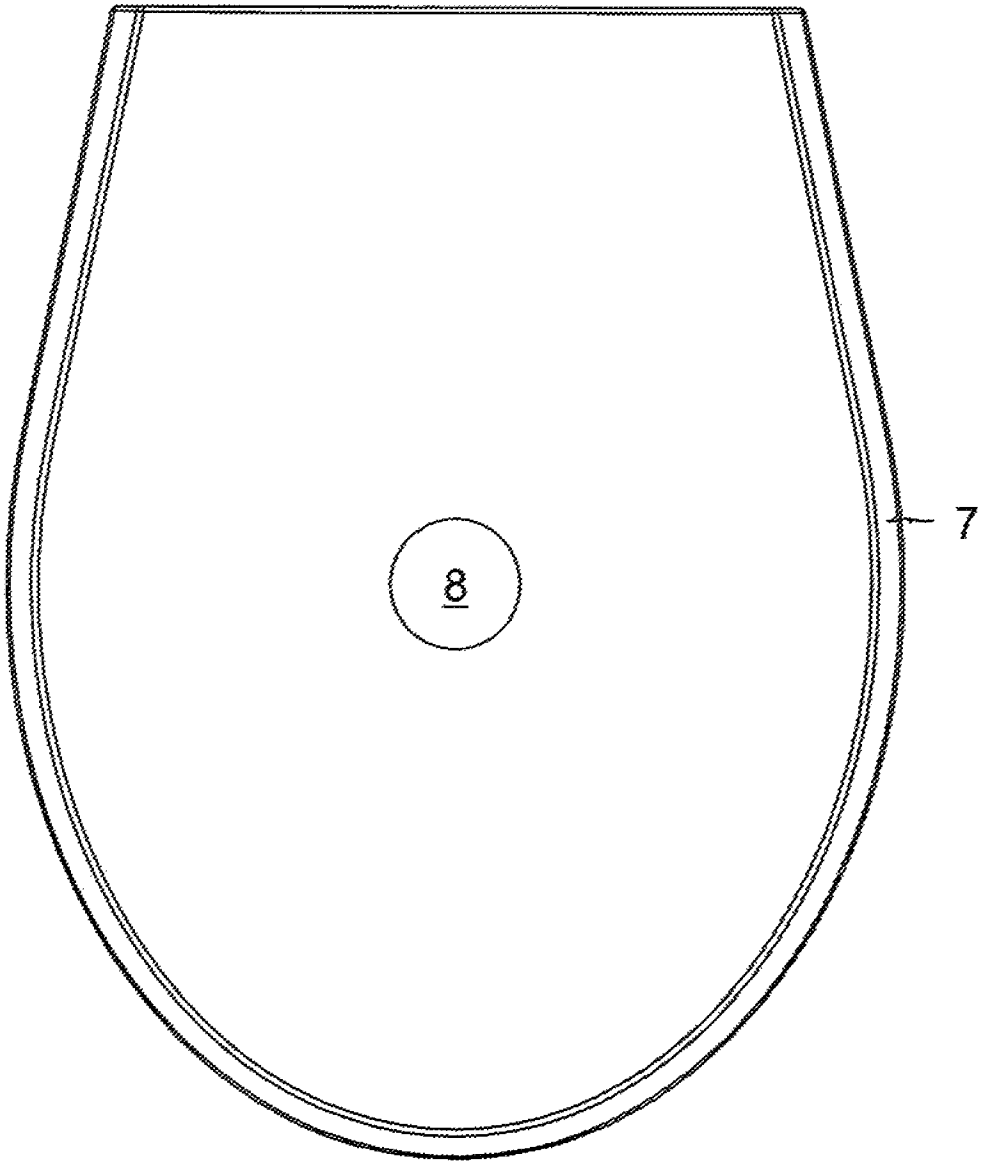

In another embodiment example, depicted in the FIGS. 3 and 4 of WO 2019/028 520 A1, the docking device consists of a recess projecting away from the toilet lid in a downwards direction and opens towards the top. The recess receives two containers filled with liquid and can be closed by a lid which in the closed state is flush with the top side of the toilet lid. A motion sensor is provided to trigger the spraying action.

The citation US 2014/0 096 314 A1 also discloses a cleaning device for a toilet seat. This solution is very similar to the one in the printed publication WO 2019/028 520 A1. Herein, the container for the cleaning liquid is arranged inside the lid and is an integral component of the lid. Emanating from the container a plurality of conduits extend within the lid radial outwards terminating in outlets pointing towards the toilet seat.

The container is in connection with an actuator which is accessible from the top side of the lid. By pressing the actuator air contained therein is compressed which then enters the container and pressed the liquid via the conduits into the outlets causing the toilet seat to be sprayed with cleaning liquid. A filling hole is provided for filling the container with cleaning liquid, and this is accessible from the top side of the lid.

In the document KR 20 0 438 841 Y1 a cleaning device for the air space above a toilet bowl with wetting the toilet seat is described, where the toilet lid serves as a holder for a spray can. The spray can is actuated by a push knob projecting out of the front side of the toilet lid.

It is the task of the present invention to provide a further apparatus according to the preamble.

This task is solved according to the invention by means of an apparatus having the features of claim 1.

This apparatus is disposed in one of the most hygienic places of a toilet where it neither troubles the user of the toilet nor provides an obstacle to cleaning activities. Moreover, the place of mounting bears the advantage that the apparatus does not have to be adapted to different geometries of toilets, e.g. different rim widths of the toilet bowl or different distances between the rim edge and the underside of the toilet seat.

An apparatus according to the invention is characterised, in a first alternative, in that the toilet lid comprises passage opening in which the container is fixed such that, in relation to its installation position, the top side thereof is accessible from the outside for manually exerting pressure to trigger a liquid discharge.

In its most simple form, namely when the discharge device is designed as one piece with the container, the apparatus consists of merely one component and, therefore, is designed to be simple.

The container can be replaced easily because it is merely inserted or, respectively, snapped or screwed into the toilet lid or, respectively, when an adapter sleeve is used, likewise, needs to be inserted or snapped or screwed respectively into this and possibly locked therein.

In a second alternative, an apparatus according to the invention is characterised in that the container is an integral component of the toilet lid and can be reversibly closed using a lid, and this is accessible from the outside for manually exerting pressure to trigger a liquid discharge.

The container can be refilled easily in that the container lid is simply unscrewed or removed respectively. Over the service life of a toilet seat both the container lid as well as the pumping and spraying device, unless they are part of the toilet lid, can be replaced as needed as independent components or, respectively, as part of the outlet head together therewith.

By virtue of the positioning in the toilet lid a spray shot can happen with the toilet lid closed, thereby allowing the liquid to attain its optimum efficiency because, usually, only a short time passes between opening the toilet lid and a user sitting down on the toilet seat, thereby practically closing the toilet bowl again.

Further advantageous embodiments of the invention are specified in the sub-claims.

Figure 2:
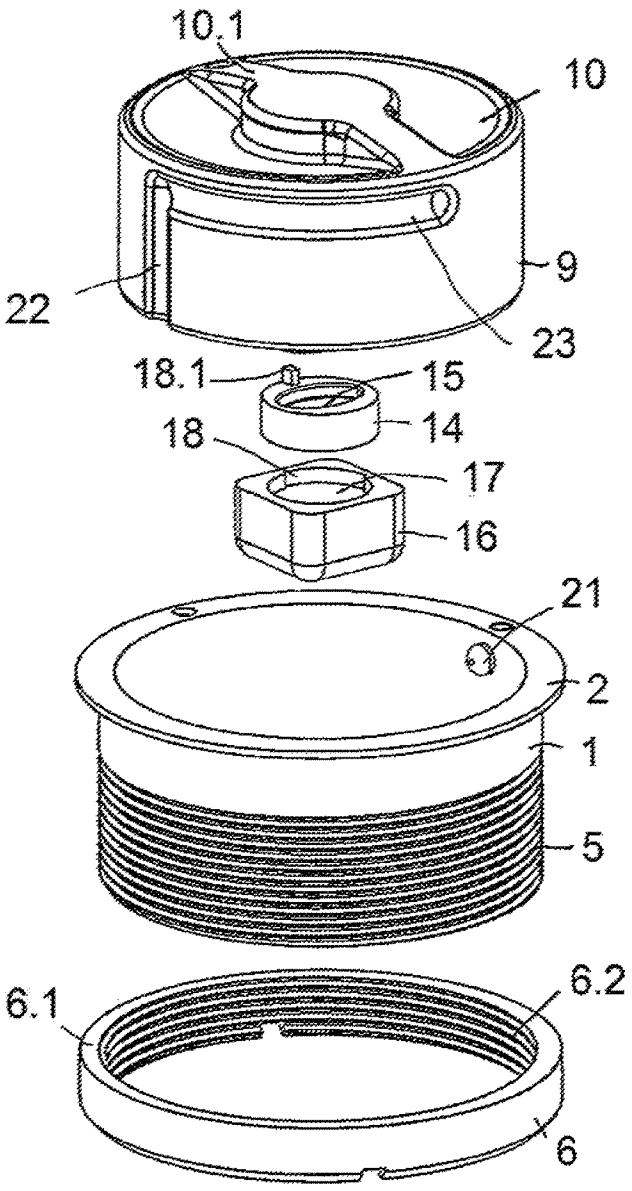
Figure 5:
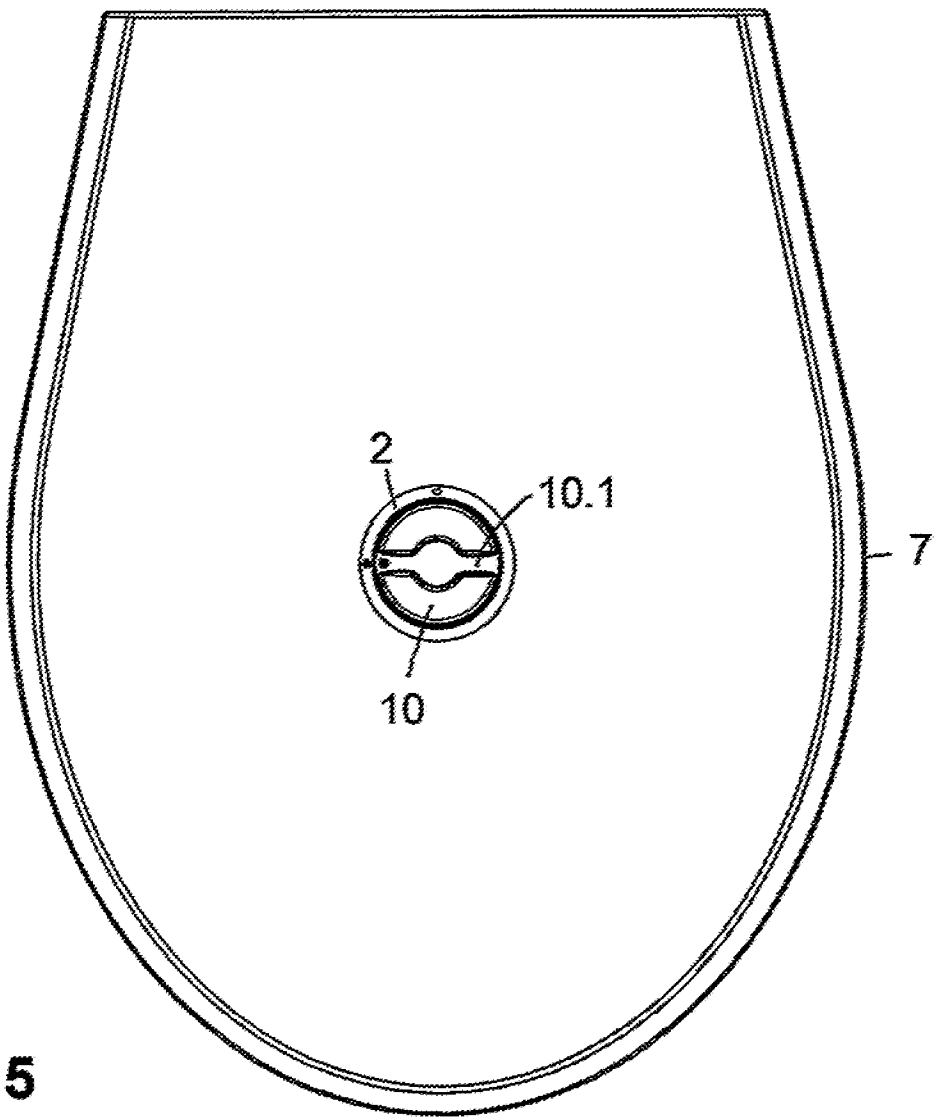
Figure 6:
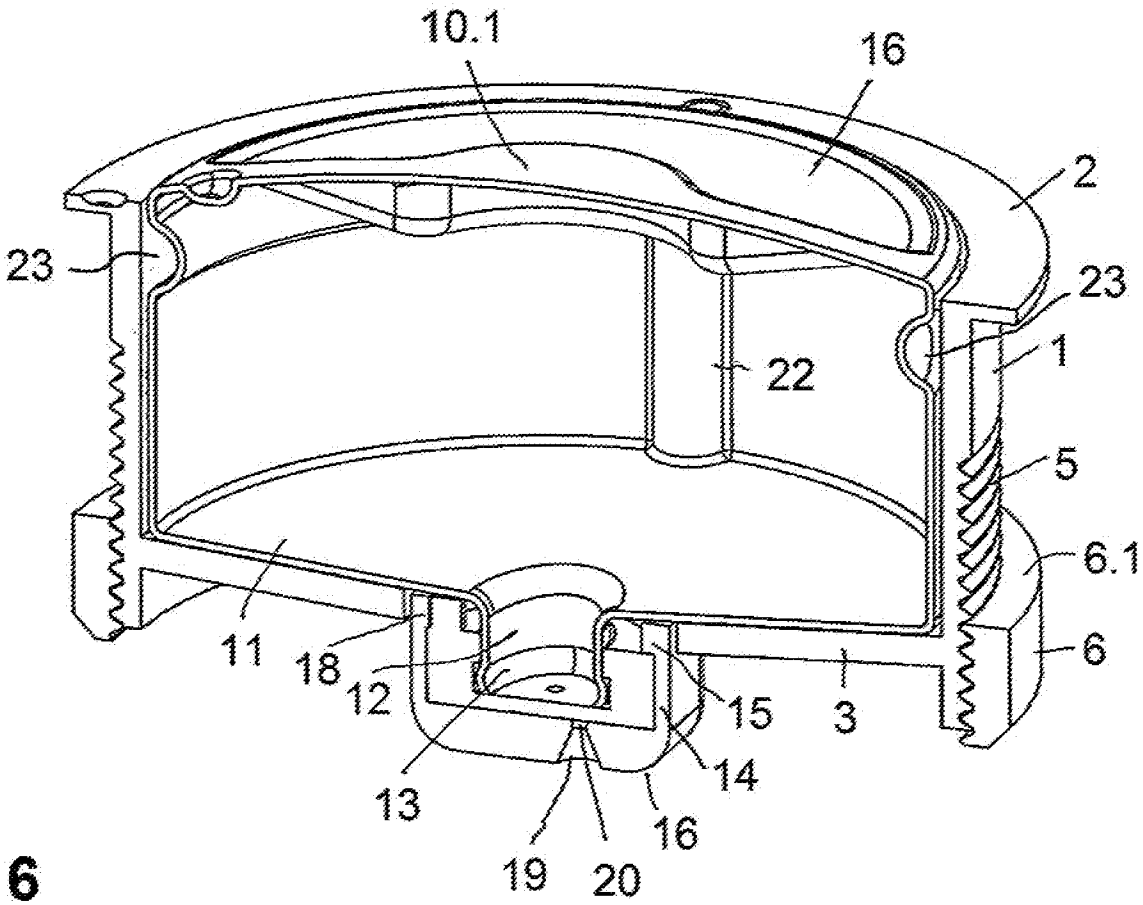
Figure 7:
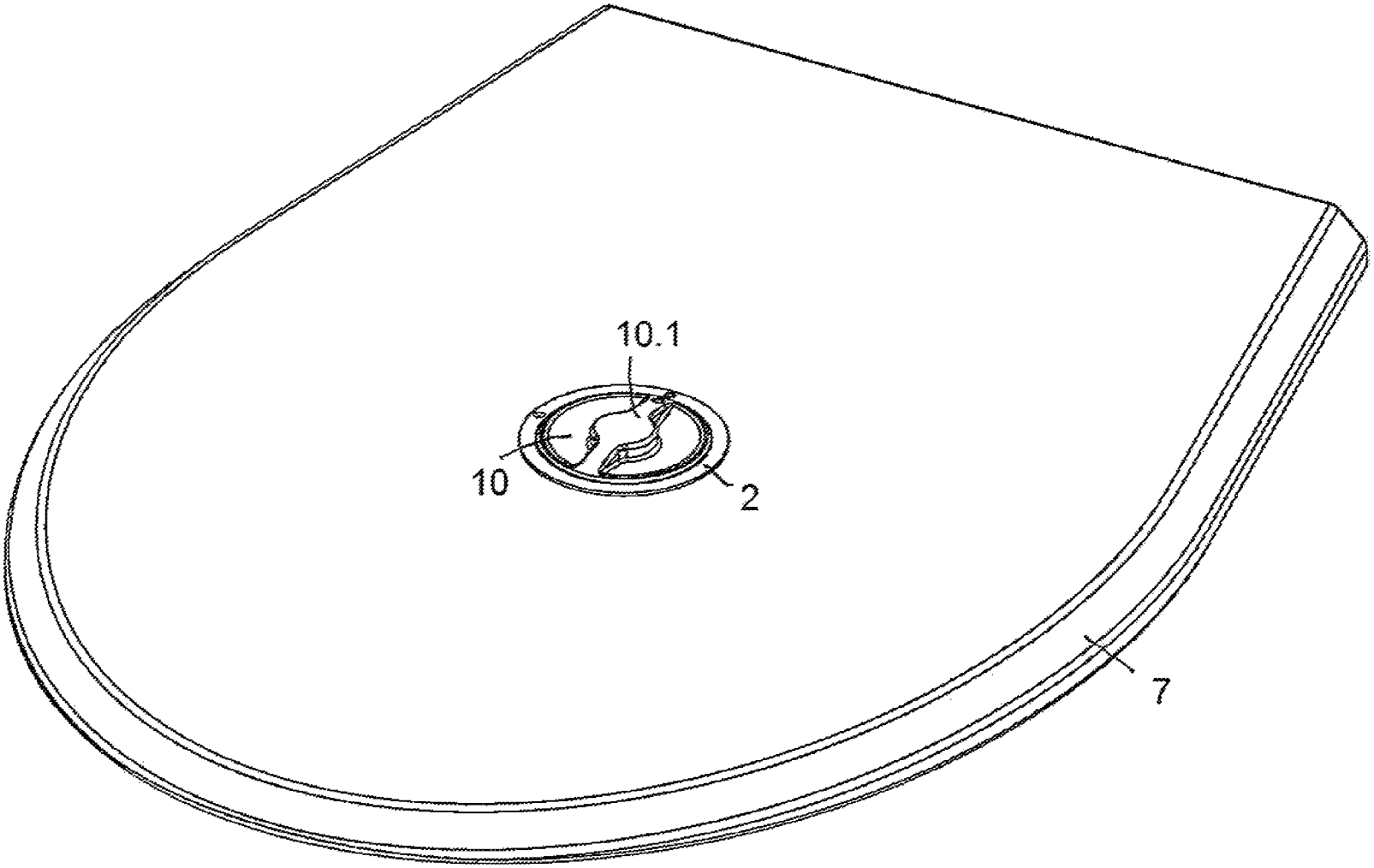
Figure 8:
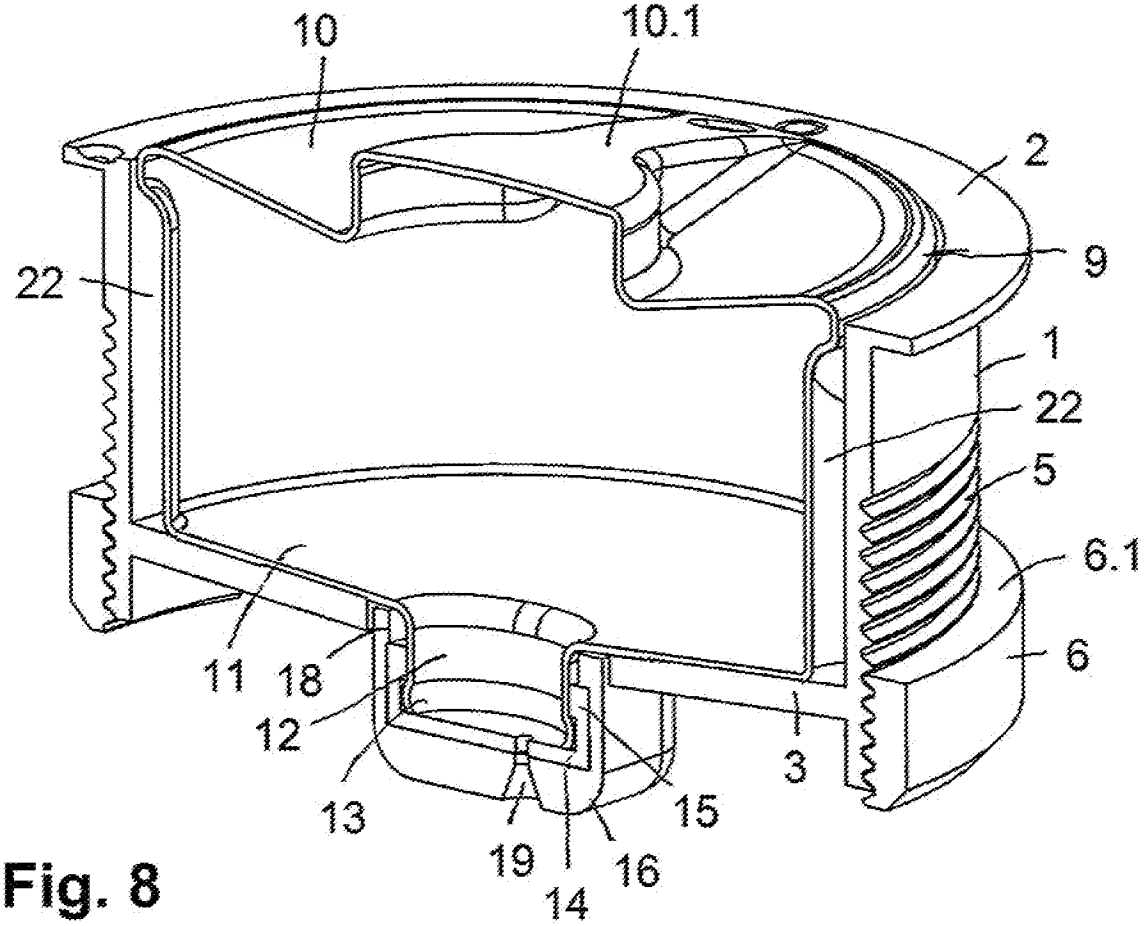
Figure 17:
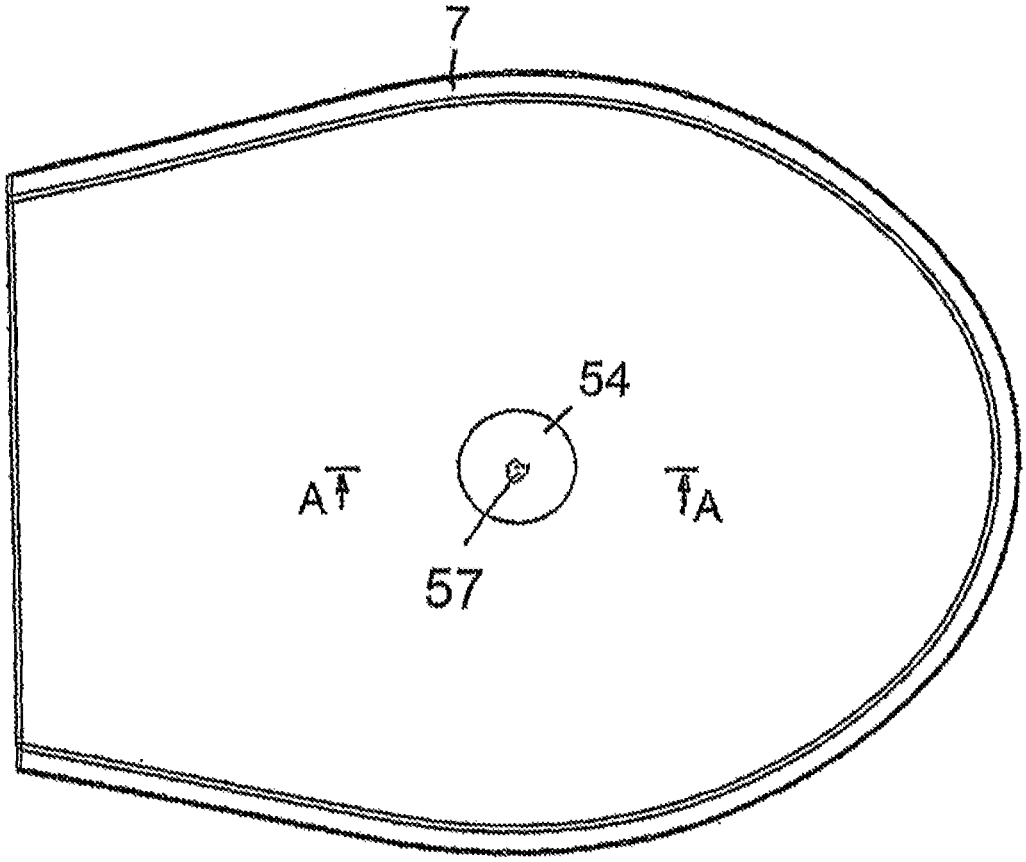
Figure 18:
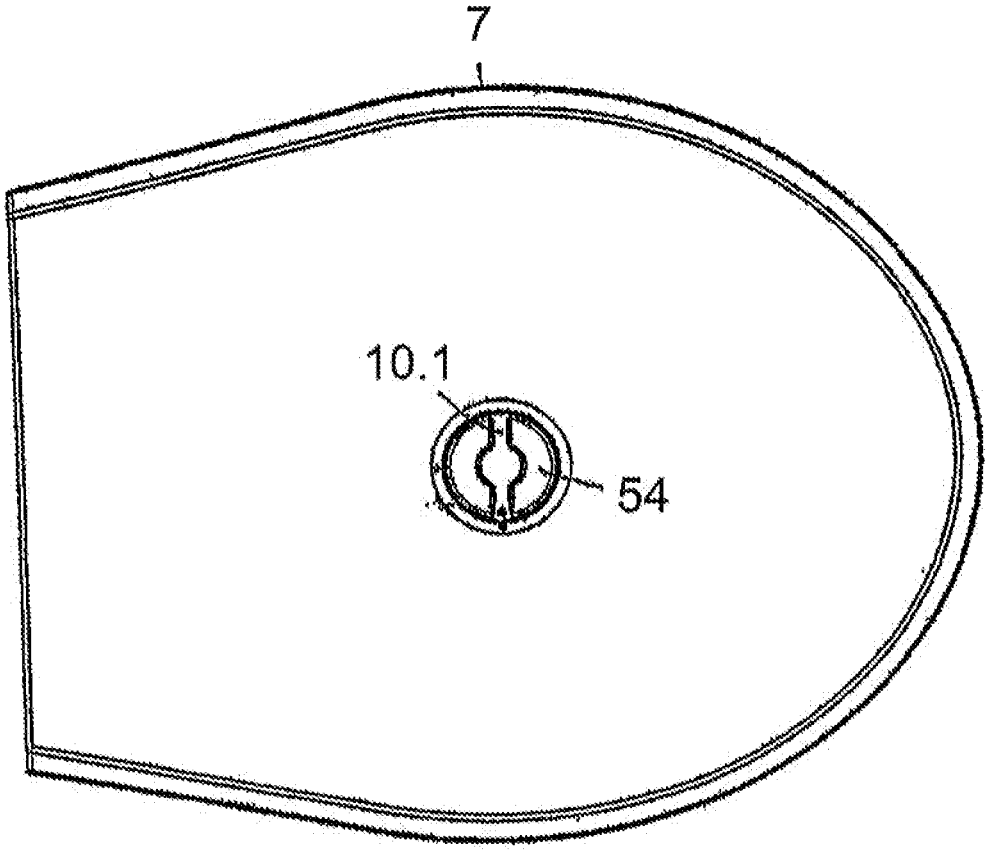

The invention is further illustrated below by means of embodiment examples. The accompanying drawing shows in:

FIG. 1 a perspective view diagonally from above on an apparatus according to the invention, FIG. 2 an exploded view of the apparatus according to FIG. 1, FIG. 3 an exploded view of the apparatus according to FIG. 1 from a viewing angle diagonally from below, FIG. 4 a plan view on a toilet lid with a passage opening for installation of an apparatus according to the invention, FIG. 5 a representation according to FIG. 4 with an apparatus installed in the state of locked nozzles, FIG. 6 an apparatus cut up in half in the state of locked nozzles, FIG. 7 a perspective view diagonally from above on a toilet lid with apparatus installed in the state of unlocked nozzles, FIG. 8 an apparatus cut up in half in the state of unlocked nozzles, FIG. 9 an apparatus cut up in half in a second embodiment of the invention, FIG. 10 an exploded view of the apparatus according to FIG. 9, FIG. 11 an apparatus cut up in half in a third embodiment of the invention, FIG. 12 a cross-section of the apparatus according to FIG. 11 in the idle state, FIG. 13 an apparatus cut up in half in a fourth embodiment of the invention, FIG. 14 a cross-section of the apparatus according to FIG. 13 in the actuated state, FIG. 15 a plan view of a toilet lid with two apparatus' according to the invention installed, FIG. 16 a bottom view of the representation of FIG. 15, FIG. 17 a plan view of a toilet lid with an integrated container, FIG. 18 a representation according to FIG. 17 in a modified embodiment, FIG. 19 a section A-A according to FIG. 17 in a first embodiment of the integrated container, FIG. 20 a section A-A according to FIG. 17 in a second embodiment of the integrated container, and FIG. 21 a container integrated in the toilet lid with suction and pressure line of a pump dispenser.

An apparatus represented in the FIGS. 1 through 8 according to a first embodiment of the invention comprises an adapter sleeve 1 with circular cross-section. The adapter sleeve 1 opens at the top and has a flange 2 at its upper edge. In its lower region the adapter sleeve 1 is closed by a bottom 3 the centre of which is provided with a rectangular passage hole 4. The adapter sleeve 1 further comprises an external thread 5 upon which a clamp ring 6 with a corresponding internal thread 6.2 can be screwed.

For mounting in a toilet lid 7 the adapter sleeve 1 is inserted from above through a circular passage opening 8 of the toilet lid 7, located approximately in the centre thereof (FIG. 4), until the flange 2 rests on the top side of the toilet lid 7. Subsequently, the clamp ring 6 is screwed onto the external thread 5 of the adapter sleeve 1 up to the point where its front surface 6.1 is in contact with the underside of the toilet lid 7. Thus, the adapter sleeve 1 is affixed to the toilet lid 7.

The apparatus according to the invention further includes a container 9 auf which receives the liquid containing at least one active substance. The container 9 is designed to be one piece with a top side 10 and an underside 11. At the top side 10 a handle strip 10.1 is formed, and an outlet nozzle 12 projects centrally from its underside 11, the nozzle having an oval cross-section hat and a snap edge 13 at its free end. A control disc 14 is latched onto the outlet nozzle 12. To that end, it is provided with an oval interior cross-section fitting the outlet nozzle 12 as well as a snap edge 15. An outlet head 16 is latched on the control disc 14 affixed to the outlet nozzle 12. To that end, this is provided with a circular opening 17 with snap edge fitting the exterior circular cross-section of the control disc 14 and a 90° recess 18 to receive the rotary limiter 18.1. the exterior cross-section of the outlet head 16 is adapted to the an cross-section of the passage hole 4 in the bottom 3 of the adapter sleeve 1. The outlet head 16 is provided with a spray nozzle 19.

The control disc 14 has a passage opening 20. When the container 9 has not been used before the spray nozzle 19 of the outlet head 16 and the passage opening 20 of the control disc 14 are not overlapping so that no liquid can leak. In order to prevent undesired rotation between control disc 14 and outlet head 16 a predetermined breaking point may be provided between the control disc 14 and the outlet head 16 which is destroyed upon initial intended use of the container 9.

For intended use the container 9 with latched control disc 14 and latched outlet head 16 is inserted into the adapter sleeve 1. For this purpose, two diametrically opposed guide cams 21 are provided in the upper edge region of the adapter sleeve 1 on the interior wall. Complementary hereto, guide grooves 22 are arranged on the exterior wall of the container 9. To enable aligned insertion of the container 9 into the adapter sleeve 1 the guide cams 21 are made to overlap with the inlets of the guide grooves 22. The container 9 can now be pressed into the adapter sleeve 1, whereby the guide cams 21 slide in the guide grooves 22 and finally reach an upper abutment.

At this point the guide grooves 22 merge into a section 23 arranged perpendicular thereto. The container 9 can now be twisted clockwise, whereby the guide cams 21 slide in the sections 23 up to a end abutment. Because such twisting of the container 9 carries along the control disc 14 sitting untwistably on the outlet nozzle 12, while the outlet head 16 engaging positively with the passage hole 4 of the adapter sleeve 1 does not rotate, the result is a relative movement between the control disc 14 and the outlet head 16, thereby destroying a possibly existing predetermined breaking point. When the guide cams 21 are in contact with the end abutments of the sections 23, this also results in an overlapping between the passage opening 20 and the spray nozzle 19.

The top side 10 of the container 9 can be reversibly impressed so that by means of pressure exerted on the top side 10 in collaboration with the perpendicular sections 23 of the guide grooves 22 or, respectively, the bottom 3 of the adapter sleeve 1 liquid is displaced out of the container 9 and sprayed into a toilet bowl through the spray nozzle 19 positioned overlapping the passage opening 20.

In order to replace the container 9 this is rotated back counter-clockwise in the adapter sleeve 1, thereby closing it again liquid-tight so that it can be removed only when the spray nozzle 19 is closed. The handle strip 10.1 facilitates the twisting of the container 9 upon locking and unlocking.

Figure 9:
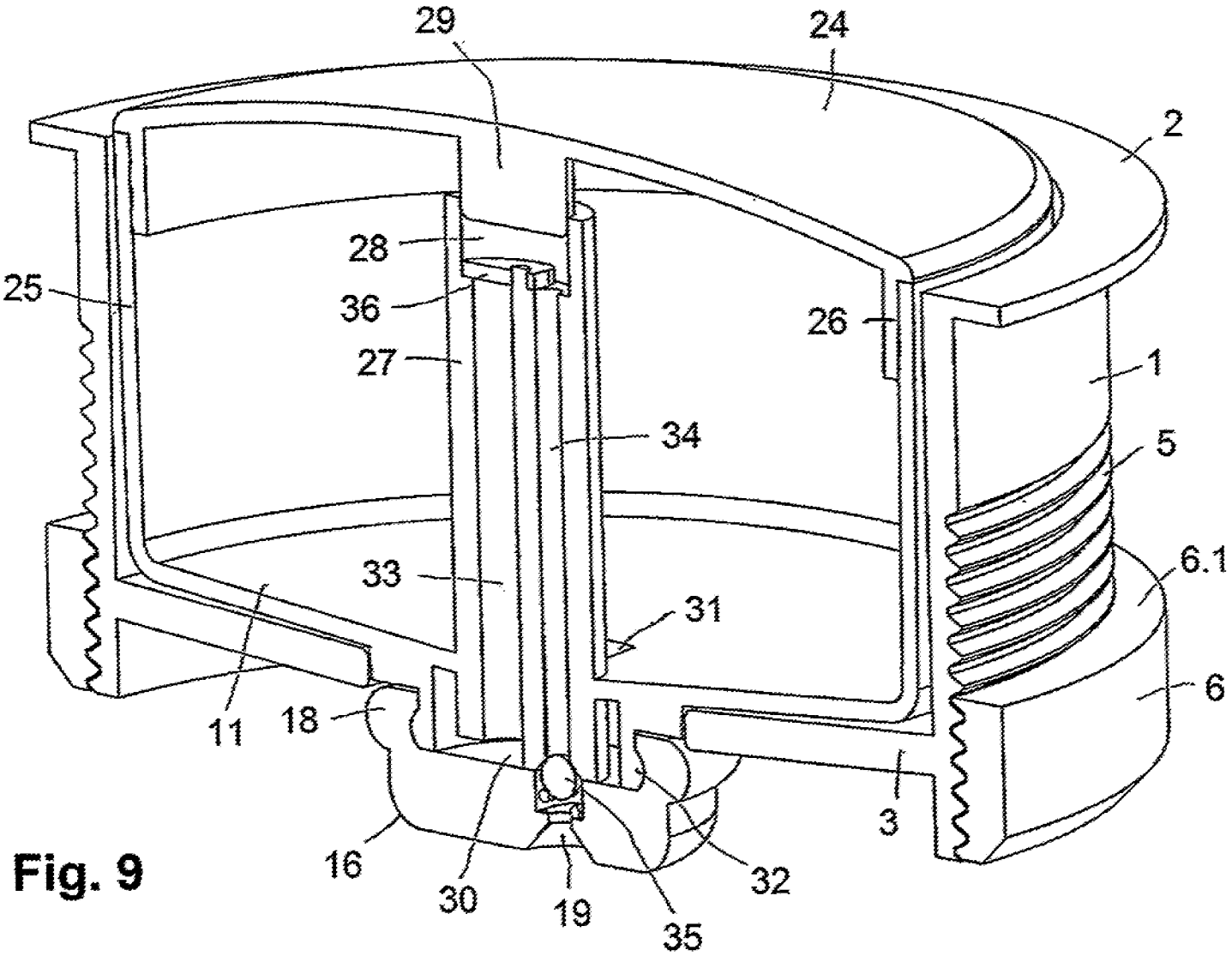
Figure 10:
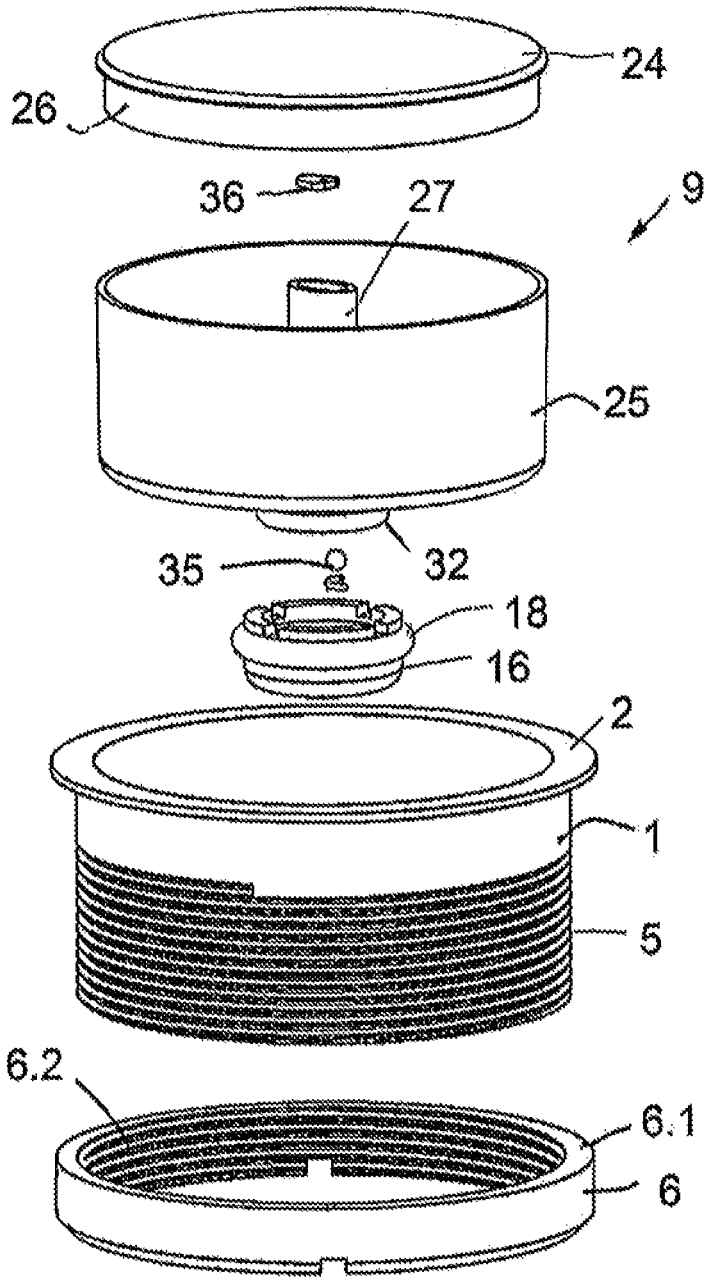

The FIGS. 9 and 10 show a further embodiment example of the present invention. This apparatus functions according to the principle of a pump dispenser. In the following, similar components shall be designated by the same reference numerals as in the above embodiment example.

In this embodiment example, too, an adapter sleeve 1 is utilised which is provided with a flange 2 at its upper edge. In the assembled state this flange 2 rests on the top side of a toilet seat 7. The adapter sleeve 1 is affixed to the toilet lid 7 by screwing a clamp ring 6 onto the external thread 5 of the adapter sleeve 1. In the fully screwed-in state the front surface 6.1 of the clamp ring 6 is in contact with the underside of the toilet lid 7.

A container 9 can be inserted into the adapter sleeve 1 with an opening in the bottom 3 to receive a liquid containing at least one active substance. The container 9 is designed as two pieces with a lid 24 and a corpus 25. The top side of the corpus 25 is open and is closed by the lid 24 which, for this purpose, has a wraparound edge 24 which, in the assembled state, lies in contact with the interior wall of the corpus 25.

The underside 11 is designed as one piece with the corpus 25. Emanating from the centre thereof projects a hollow cylinder 27 which is designed as one piece with the underside 11 but may also be realised as a separates member. At the upper end of the hollow cylinder 27 a piston chamber 28 is formed with which a piston 29 formed on the lid 24 engages when assembled.

In its lower region the hollow cylinder 27 opens into a chamber 30 formed in the underside 11. This chamber 30 is connected via a passage opening 31 arranged in the underside 11 to the interior of the container 9 receiving the liquid.

The underside of the chamber 30 is closed by an outlet head 16. This happens by sliding the outlet hear 16 onto a snap edge 32 formed on the underside 11. To that end, the outlet head 16 is provided with a corresponding snap edge 18. When the outlet head 16 is slid on the two snap edges 18 and 32 snap together.

Inside the hollow cylinder 27 a suction line 33 and a pressure line 34 are arranged. The suction line 33 opens at its upper end into the piston chamber 28 and at its lower end into the chamber 30. The upper end of the pressure line 34 also opens into the piston chamber 28, while its lower end opens into a spray nozzle 19 of the outlet head 16. To enable opening and closing the spray nozzle 19 a non-return valve 35 is mounted between this and the pressure line 34.

A partial region of the bottom of the piston chamber 28 is formed by a sealing disc 36 which guarantees that the liquid can leave the piston chamber 28 only via the pressure line 34.

In order to actuate the apparatus the lid 24 is pressed inwards so that the piston 29 in collaboration with the bottom 3 of the adapter sleeve 1 becomes immersed into the piston chamber 28. Subsequently, the lid 24 is let go so that the piston 29 re-emerges from the piston chamber 28. The flexible material of the lid 24 guarantees sufficient restoring force.

The re-emerging of the piston 29 from the piston chamber 28 creates negative pressure therein so that liquid rises from the chamber 30 via the suction line 33 into the piston chamber 28. Upon re-pressing the lid 24 liquid is pushed out of the piston chamber 28 which is fed via the pressure line 34 of the spray nozzle 19 to the outlet head 16, whereby the non-return valve 35 opens due to the pressure relations. The chamber 30 is filled again by feeding the liquid via the opening 31 in the underside 11 of the container 9.

Here, the container 9 is fixed inside the adapter sleeve 1 by means of a clamping connection, latching device, or snap connection between the underside of the container 9 and the opening in the bottom 3 of the adapter sleeve 1 or, respectively, via a clamping connection, latching device, or snap connection between the interior side of the adapter sleeve 1 and the exterior side of the container 9.

Figure 11:
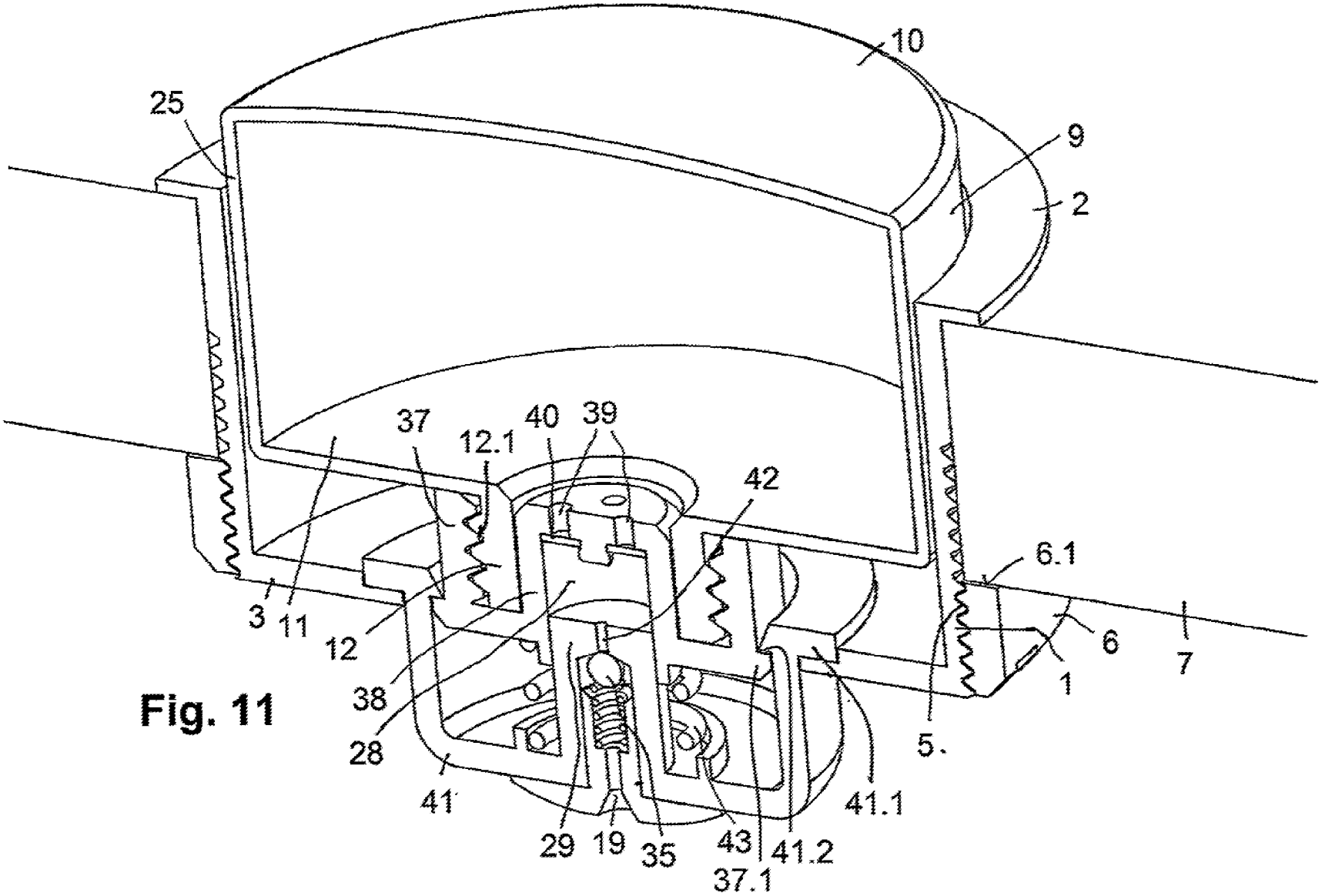
Figure 12:
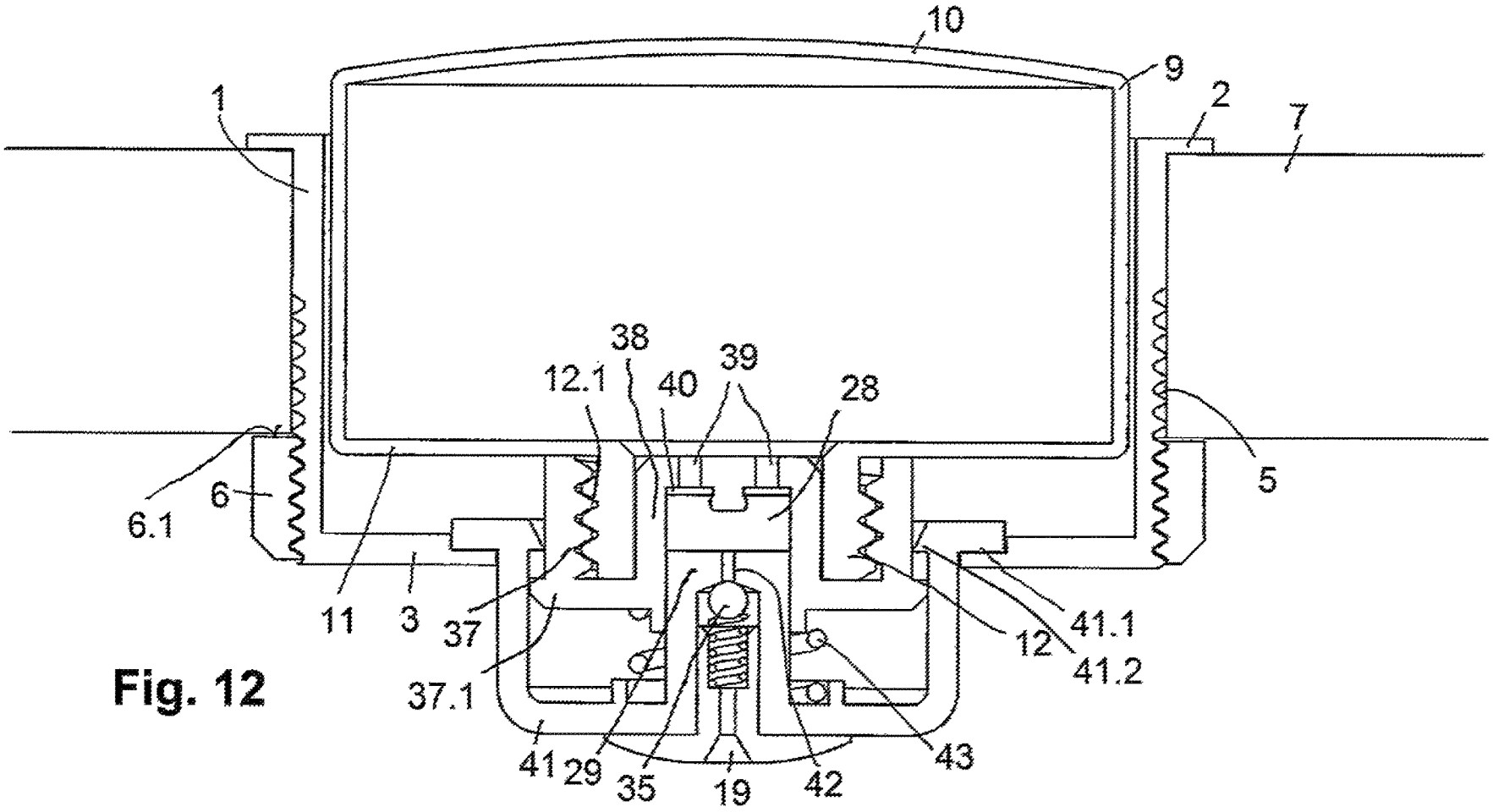

The FIGS. 11 and 12 show a third embodiment example of the present invention, wherein the apparatus is also working in accordance with the principle of a pump dispenser. Similar components shall be designated by the same reference numerals as in the above embodiment example.

In this embodiment example, too, an adapter sleeve 1 is utilised which is provided with a flange 2 at its upper edge. When assembled, this flange 2 rests on the top side of a toilet lid 7. The adapter sleeve 1 is affixed to the toilet lid 7 by means of screwing a clamp ring 6 onto the external thread 5 of the adapter sleeve 1. In the fully screwed-in state the front surface 6.1 of the clamp ring 6 lies in contact with the underside of the toilet lid 7.

A container 9 which receives a liquid containing at least one active substance can be inserted into the adapter sleeve 1. The container 9 is designed to be one piece and has a corpus 25, a top side 10, and an underside 11 from the centre of which an outlet nozzle 12 projects which has an external thread 12.1. Screwed onto the external thread 12.1 is a ring cap 37 from the bottom of which a hollow pin 38 protrudes in which a piston chamber 28 is formed. In the assembled state the hollow pin 38 will be disposed with little play inside the outlet nozzle 12 of the container 9. From the piston chamber 28 passage openings 39 penetrating the bottom of the hollow pin 38 lead into the container 9. The outlets of the passage openings 39 on the side of the piston chamber are covered by a sealing ring 40.

At the ring cap 37 a covering cap 41 is fixed. The covering cap 41 has a circumferential flange 41.1 on its exterior circumference by means of which it rests from the inside on the bottom 3 of the adapter sleeve 1. A hollow cylinder protrudes from the bottom of the covering cap 41 which in the assembled state forms a piston 29 engaging with the piston chamber 28. A non-return valve 35 is arranged inside the piston 29 which closes, when the apparatus is not actuated, a branch canal 42 leading into the piston chamber 28 so that no liquid can reach a spray nozzle 19 arranged at the covering cap 41.

A spiral spring 43 is arranged between the ring cap 37 and the covering cap 41 which is supported on the bottoms of these. The spiral spring 43 pushes container 9 in the adapter sleeve 1 into a rest position which is reached when abutments 37.1 or 41.2 respectively provided on the ring cap 37 and on the covering cap 41 adjoin each other, as depicted in FIG. 11.

To actuate the apparatus pressure is exerted on the top side 10 of the container 9 against the force of the spiral spring 43 and in co-operation with the circumferential flange 41.1 and the bottom 3 of the adapter sleeve 1 so that the container 9 becomes immersed in the adapter sleeve 1. This causes the piston 29 to penetrate deeper into the piston chamber 28 thereby generating a pressure in the piston chamber 28 causing the non-return valve 35 to open causing in turn to move liquid displaced from the piston chamber 28 towards the spray nozzle 19 from where it is sprayed. During this operation the sealing ring 40 seals the piston chamber 28 against the container 9. Now, when pressure is no longer exerted on the top side 10 of the container 9, the spiral spring 43 pushes the container 9 back into its rest position causing the piston 29 to retract in the piston chamber 28 generating a negative pressure therein. Due to this negative pressure the sealing ring 40 opens up so as to enable subsequent flow of liquid from the container 9 into the piston chamber 28. Then, when pressure is exerted again on the top side 10 of the container 9, the next spray shot occurs.

The hold of the container 9 in the adapter sleeve 1 is caused by a clamping connection, latching or snap connection between the covering cap 41 and the opening in the bottom 3 of the adapter sleeve 1.

Figure 13:
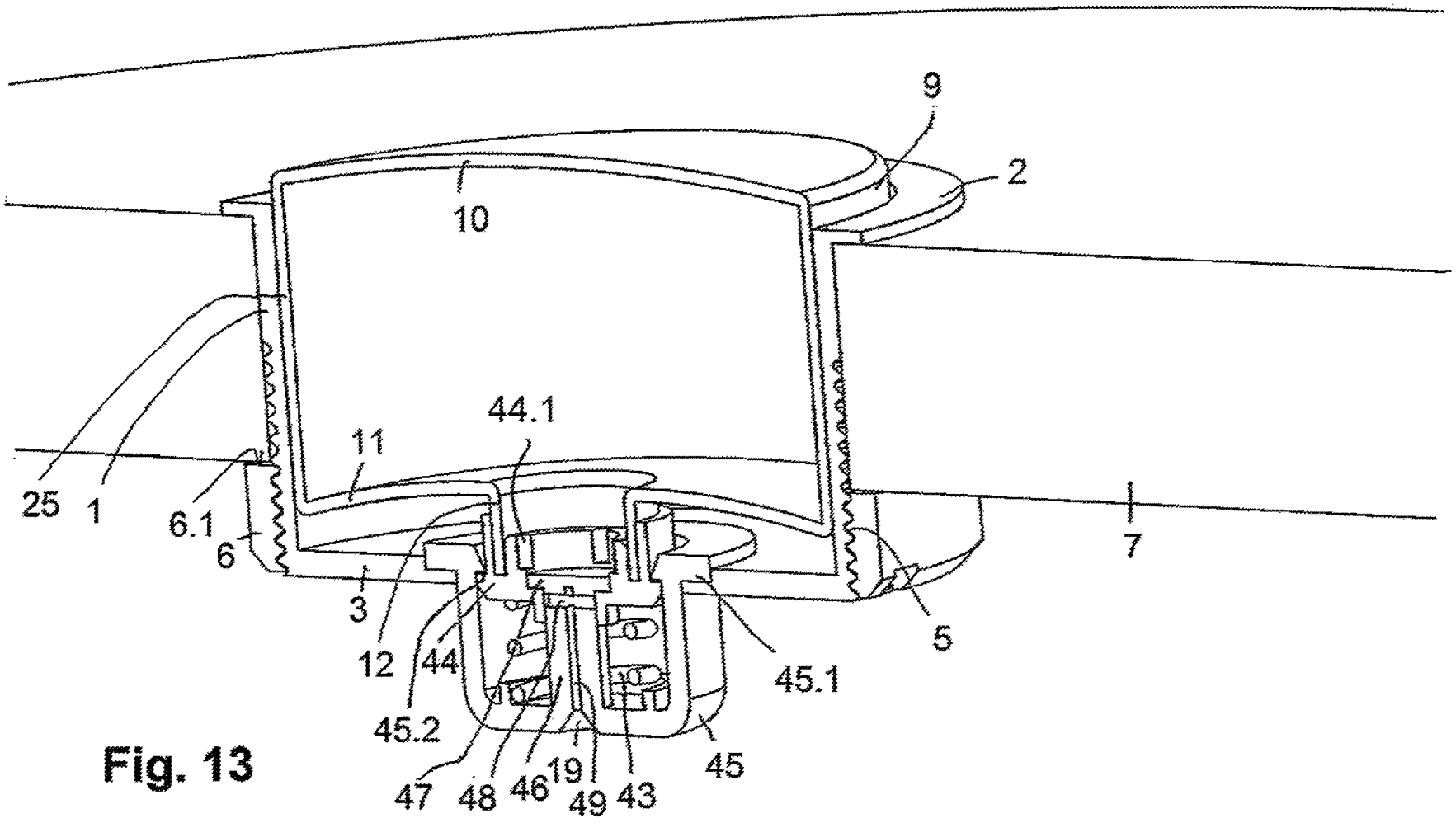
Figure 14:
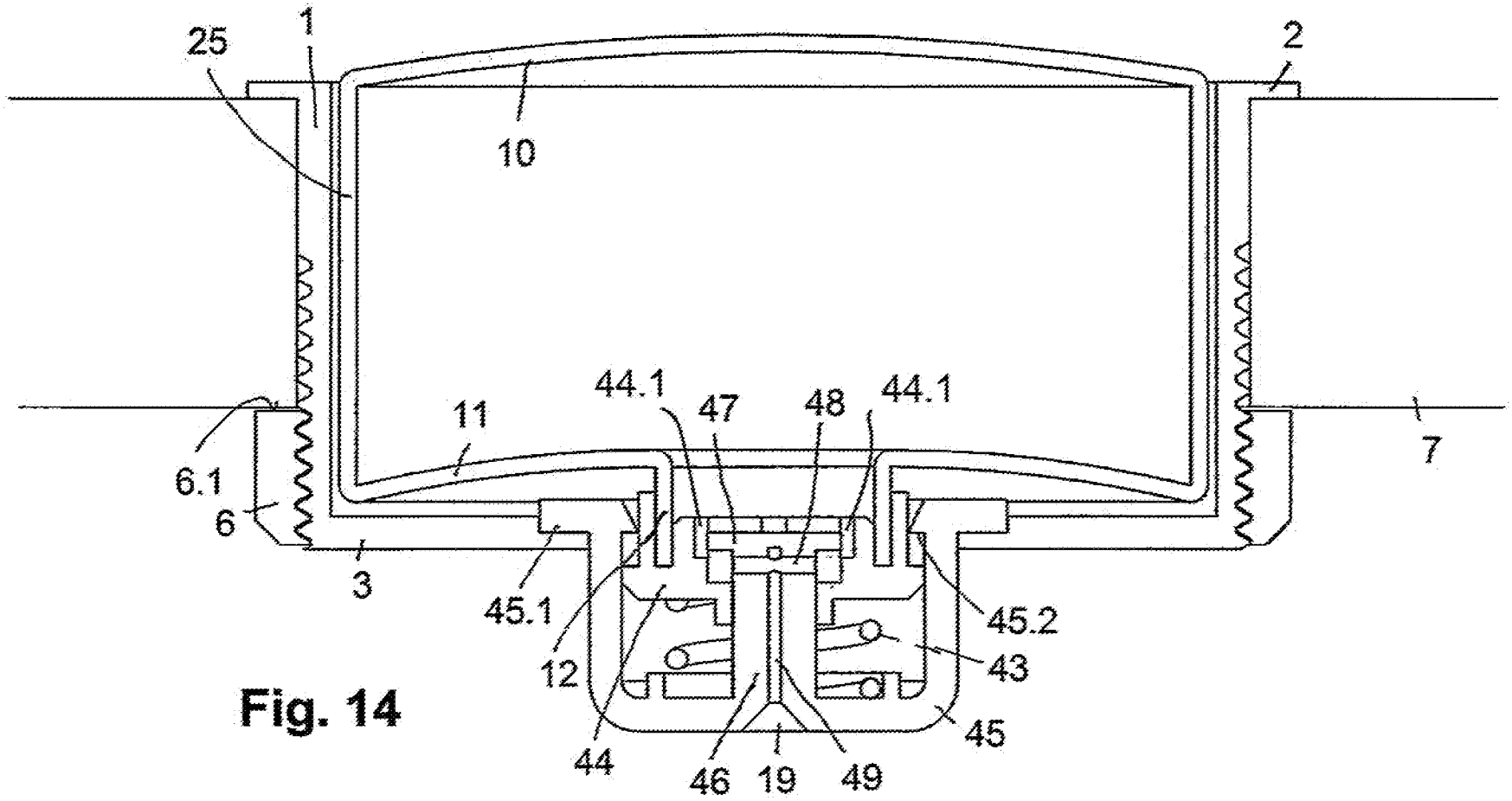

The FIGS. 13 and 14 show a further embodiment example of the present invention. In this case, the apparatus is designed according to the principle of a spray can. Similar components are designated by the same reference numerals as in the preceding embodiment examples.

In this embodiment example, too, an adapter sleeve 1 is utilised which has a flange 2 at its upper edge. In the assembled state this flange 2 rests on the top side of a toilet lid 7. The adapter sleeve 1 is affixed to the toilet lid 7 by screwing a clamping ring 6 onto the external thread 5 of the adapter sleeve 1. In the fully screwed-on state the front surface 6.1 of the clamping ring 6 is in contact with the underside of the toilet lid 7.

A container 9 can be inserted into the adapter sleeve 1 which receives a liquid containing at least one active substance as well as a propellant. It consists of a corpus 25, a top side 10 and an underside 11. An outlet nozzle 12 projects away from the centre of the underside 11 onto which a valve seat 44 is slid. The valve seat 44 has two diametrically opposite windows 44.1 in which the liquid inside the container 9 is present. The windows 44.1 open towards the interior side of the valve seat 44.

In the bottom 3 of the adapter sleeve 1 a circular opening is provided which receives a nozzle cap 45. The nozzle cap 45 has a circumferential flange 45.1 on its exterior perimeter by means of which it rests on the bottom 3 of the adapter sleeve 1. On its interior side the nozzle cap 45 has a circumferential abutment 45.2 for the valve seat 44. Between the valve seat 44 and the nozzle cap 45 a spiral spring 43 is clamped in which pushes the valve seat 44 against the abutment 45.2 of the nozzle cap 45.

The nozzle cap 45 is provided with a plunger 46 terminating at its free end in a sealing disc 47. The sealing disc 47 rests on a shoulder of the valve seat 44 where it seals due to the pressure force of the spiral spring 43. Thus, in the non-actuated state, no liquid can leak from the container 1.

In the plunger 46 a branch canal 49 is formed which at one of its ends terminates in a spray nozzle 19 and at its other end in a transverse canal 48 designed as through bore through the plunger 46.

Upon actuation by exertion of pressure on the top side 10 of the container 9 the valve seat 44 is pushed into the nozzle cap 45 in co-operation with the circumferential flange 45.1 and the bottom 3 of the adapter sleeve 1 against the force of the spiral spring 43. This causes the windows 44.1 to overlap with the outlets of the transverse canal 48 so that liquid is able to flow via the transverse canal 48 and the branch canal 49 towards the spray nozzle 19 from where it is sprayed as a fine mist into the toilet bowl.

The hold of the container 9 in the adapter sleeve 1 is caused by a clamping connection, latching or snap connection between the nozzle cap 45 and the opening in the bottom 3 of the adapter sleeve 1.

Figure 15:
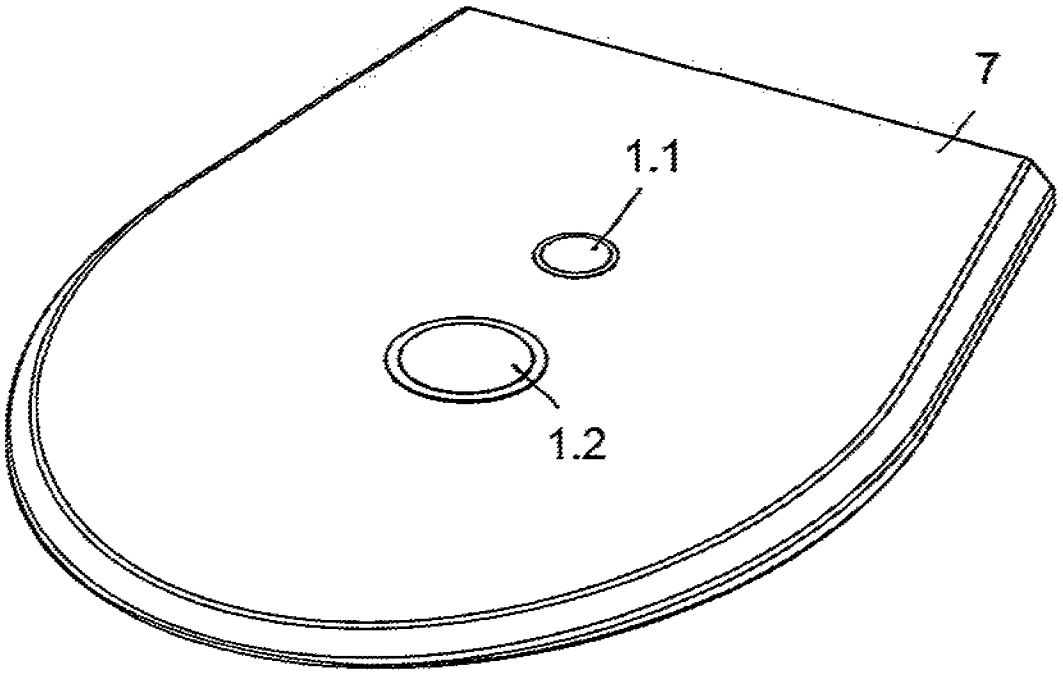
Figure 16:
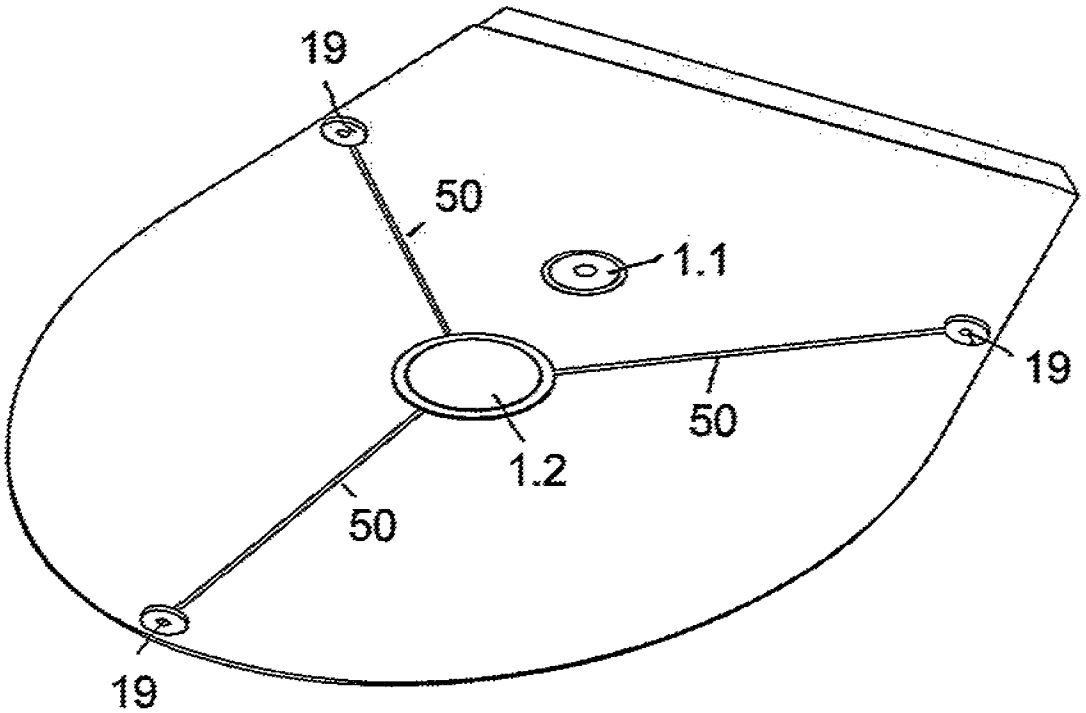

The FIGS. 15 and 16 show a further embodiment example of the invention, In this case two adapter sleeves 1.1 and 1.2 are recessed in the toilet lid 7. As in the case of the previous embodiment examples, the adapter sleeve 1.1 receives a container with a liquid for neutralising odours. The other adapter sleeve 1.2, however, receives a container with a disinfectant. The containers cannot be seen in the representation. They correspond to the containers 9 of the above embodiment examples. From the container 9 arranged in the adapter sleeve 1.2 outlets lead to branch lines 50 which terminate in the spray nozzle 19 arranged above the toilet seat and may be integral components of the rubber stops between the toilet lid 7 and the toilet seat. When pressure is exerted on the container 9 the disinfectant flows towards the spray nozzles 19 where it will be vaporised, whereby it is evenly distributed with the toilet lid 7 being closed on the toilet seat and this can then be cleaned using a cloth or a piece of paper.

In all embodiments of the invention, the adapter sleeve 1 may also be glued in, screwed in or snapped in or be designed as one piece with the toilet lid 7. In this case the clamp ring 6 can be omitted, the flange 2 will then no longer be mandatory.

Moreover, for reasons of space, the pressure increasing systems may also be arranged within the container, and the tope sides of the container may also be flush with the toilet lid or, respectively, be recessed embedded in the toilet lid.

Figure 19:
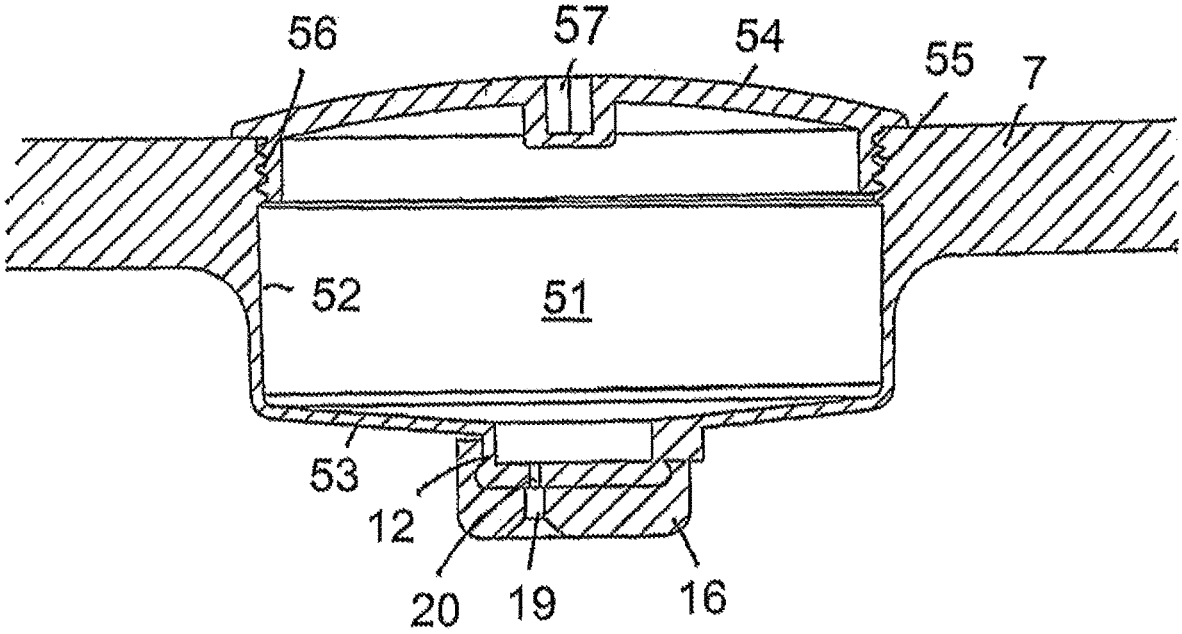

An apparatus 1 according to the invention according to FIG. 19 comprises a container 51 receiving the liquid containing at least one active substance. The container 51 is an integral component of a toilet lid 7, i.e. designed as one piece therewith. It has a circumferential lateral wall 52 merging at its lower end into a bottom 53 in which an outlet nozzle 12 for the liquid is provided onto which an outlet head 16 with a spray nozzle 19 is latched. Inside the outlet nozzle 12 runs a passage opening 20 which terminates in the spray nozzle 19.

At its upper end the container 51 in this embodiment is open and can be reversibly closed by a screwing on a lid 54 to enable refilling of the container 51, where other liquid-tight connections between container 51 and lid 54 are also possible. To that end, the side wall 52 is provided with an internal thread 55 at its upper end. The lid 54 comprises a corresponding external thread 56. For the purpose of twisting the lid 54 this may also be provided with a hexagon socket 57 or a handle strip 10.1, as can be seen in FIGS. 17 and 18.

The lid 54 can be impressed in a reversible manner so that by means of pressure on its top side liquid is displaced from the container 51 sprayed via the spray nozzle 19 into the toilet bowl.

Figure 20:
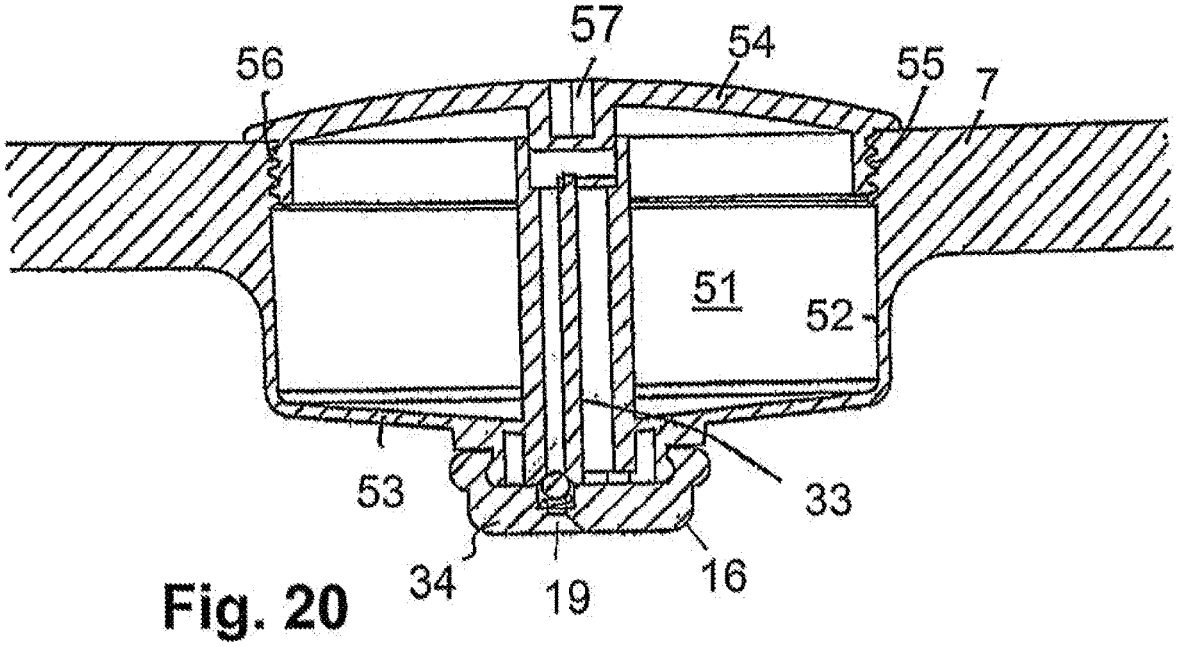
Figure 21:
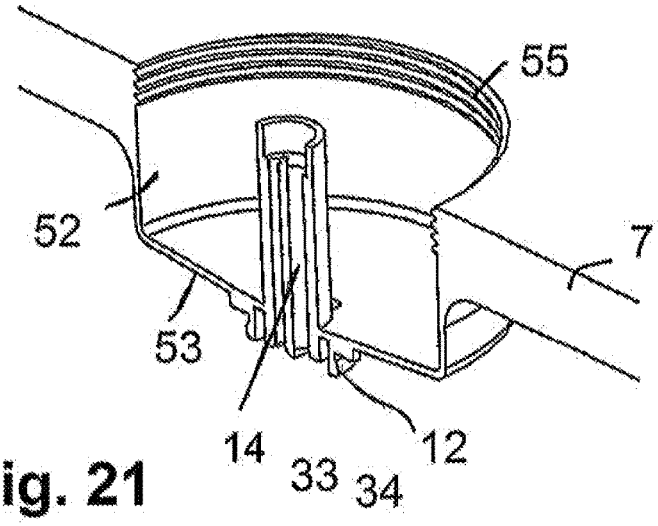

The FIGS. 20 and 21 show a further embodiment example of the present invention. Here, too, the container 51 forms an integral part of a toilet lid 7. It has a circumferential side wall hat 52 that merges at its lower end into a bottom 53, this, in FIG. 21, being formed inwards to be a part of a piston pump one-piece with suction 33 and pressure channel 34.

At its upper end the container 51 is open and can be reversibly closed by a screwing on a lid 54 to enable refilling of the container 51. To that end, the side wall 52 is provided with an internal thread 55 at its upper end. The lid 54 comprises a corresponding external thread 56. The embodiment of this apparatus corresponds to that represented in FIG. 9.

The invention claimed is:

1. An apparatus for discharging a liquid containing at least one active substance into a toilet bowl coverable by a toilet lid comprising a top side and an underside, the apparatus comprising a container receiving the liquid, the container being fixed in the toilet lid and being operatively connected to a discharging apparatus pointing into the toilet bowl with the toilet lid being closed such that the liquid is discharged into the toilet bowl via the discharging apparatus by pressure in the container, wherein the container comprises a top side and an underside, wherein the toilet lid has a circular passage opening that completely penetrates the toilet lid from the top side of the toilet lid to the underside of the toilet lid and in which the container is fixed such that, in relation to the installation position of the container, the top side of the container is accessible from the top side of the toilet lid for manually exerting pressure to trigger a liquid discharge, wherein an adapter sleeve having a circular cross-section is fixed in the passage opening in the toilet lid, with the adapter sleeve being a separate component, or forming the passage opening in the toilet lid with the adapter sleeve being an integral component of the toilet lid, and wherein the container is inserted and axially fixed in the adapter sleeve such that the top side of the container faces in the same direction as the top side of the toilet lid.

2. The apparatus of claim 1, wherein the adapter sleeve is fixed in the passage opening via a threads with a counter nut, via a snap-action connection against the underside of the toilet lid, or by being pasted in.

3. The apparatus of claim 1, wherein the container can be inserted or screwed into the adapter sleeve or is connected thereto via a snap coupling.

4. The apparatus of claim 1, wherein the interior wall of the adapter sleeve and the exterior wall of the container are provided with complementary sections of a bayonet catch so that the container can be axially fixed on the adapter sleeve by axial insertion and subsequent twisting.

5. The apparatus of claim 1, wherein the discharge apparatus is a spray nozzle.

6. The apparatus of claim 1, wherein the top side of the container, in total or in a partial region, can be compressed in a reversible manner to discharge liquid into the toilet bowl.

7. The apparatus of claim 1, wherein the adapter sleeve includes a replaceable clamp ring to guarantee, upon replacement thereof, the fixation of the container when the clamp ring has worn out.

8. The apparatus of claim 5, wherein the spray nozzle is interacting with the container such that upon exerting pressure on a top side of the container, liquid is moved toward the spray nozzle from where it is sprayed into the toilet bowl.

9. The apparatus of claim 5, wherein the apparatus comprises a piston, a piston chamber, and a non-return valve, and wherein upon exerting pressure on a top side of the container, the piston generates a pressure in the piston chamber causing the non-return valve to open causing in turn to move liquid the said piston chamber toward the spray nozzle from where it is sprayed.

* * * * *